United States Patent [19]

Bragg

[11] 4,430,243

[45] Feb. 7, 1984

[54] BLEACH CATALYST COMPOSITIONS AND USE THEREOF IN LAUNDRY BLEACHING AND DETERGENT COMPOSITIONS

[75] Inventor: Charles D. Bragg, Newcastle upon Tyne, England

[73] Assignee: The Procter & Gamble Company, Cincinnati, Ohio

[21] Appl. No.: 403,376

[22] Filed: Jul. 30, 1982

[30] Foreign Application Priority Data

Aug. 8, 1981 [GB] United Kingdom ..... 8124302
Dec. 16, 1981 [GB] United Kingdom ..... 8137967
Jun. 1, 1982 [GB] United Kingdom ..... 8215890

[51] Int. Cl.[3] ..... C11D 3/04; C11D 3/39; C11D 11/00; D06L 3/02

[52] U.S. Cl. ..... 252/91; 8/111; 252/90; 252/95; 252/99; 252/102; 252/186.33; 252/186.38; 502/150

[58] Field of Search ..... 252/102, 182, 186.33, 252/186.38, 95, 99, 429 R, 428, 429 C, 430, 431 C, 90, 91; 8/111

[56] References Cited

U.S. PATENT DOCUMENTS 3,156,654 11/1964 Konecny ..... 252/95
3,583,924 6/1971 Demangeon ..... 252/102
3,736,224 5/1973 Grayson ..... 8/111 X
4,119,557 10/1978 Postlethwaite ..... 252/99
4,299,739 11/1981 Esposito ..... 252/545

FOREIGN PATENT DOCUMENTS 984459 2/1965 United Kingdom .
1182143 2/1970 United Kingdom .
1192524 5/1970 United Kingdom .

*Primary Examiner*—Dennis L. Albrecht
*Attorney, Agent, or Firm*—Robert B. Aylor; Richard C. Witte; Thomas H. O'Flaherty

[57] ABSTRACT

Laundry bleaching and detergent compositions comprising a peroxygen bleaching agent and a catalyst system therefor, the catalyst system comprising a heavy metal cation of defined bleach catalytic activity, particularly copper, iron or manganese cations, an auxiliary metal cation having little or no bleach catalytic activity, particularly zinc or aluminium cations, and a sequestrant having defined stability constants for the catalytic and auxiliary metal cations, particularly ethylenediaminetetraacetic acid, ethylenediaminetetra(methylenephosphonic acid) and water-soluble salts thereof. The laundry bleaching and detergent compositions deliver improved bleach performance, particularly at medium to high wash temperatures. Catalyst compositions for peroxygen bleaching agents are also disclosed.

7 Claims, No Drawings

BLEACH CATALYST COMPOSITIONS AND USE THEREOF IN LAUNDRY BLEACHING AND DETERGENT COMPOSITIONS

TECHNICAL FIELD

The present invention relates to a catalyst composition for a peroxygen bleaching agent and to laundry bleaching and detergent compositions made therewith. In particular, it relates to laundry bleaching and detergent compositions having more effective bleaching activity.

BACKGROUND

The use of peroxygen bleaching agents for washing clothes and other household articles has long been known. They are particularly valuable for removing stains having a significant content of colouring matter, for instance, tea, coffee, fruit, wine and cosmetic stains. Commonly, the bleaching agent takes the form of a peroxy salt such as sodium perborate or sodium percarbonate. This is typically added to a laundry detergent composition at a level in the range from about 5% to about 35% by weight.

The effectiveness of the bleaching agent tends to be limited, however, by competing side reactions, particularly by decomposition of the bleaching agent with release of gaseous oxygen. As is well known, certain heavy metal impurities introduced into the wash process via the wash liquor, wash load or detergent ingredients can act as a catalyst for decomposition of the bleaching agent and for this reason, it is common to add a sequestering agent such as ethylenediaminetetra acetic acid (EDTA) or its salts to control the level of free heavy metal ions in solution. The effect of this under normal conditions, however, is to suppress the level of bleaching activity.

Heavy metal impurities not only catalyse decomposition of the bleaching agent, however, but they can also act to enhance the oxidizing activity of the bleaching agent if present in very small, but precisely controlled proportions. The overall objective, therefore, is to regulate the level of heavy metal ions in the wash liquor so as to provide the optimum balance of oxidizing activity and bleach decomposition.

One approach to this problem is taught in British Pat. No. 984459 wherein a combination of a copper salt and a sequestering agent having a copper dissociation constant in the range from −11 to −15, is used together with a water-soluble perborate bleaching agent. The dissociation constant of the complex is such as to provide a level of free copper ions in solution in the range necessary for activation of the perborate. Unfortunately, however, the buffering capacity of the sequestrant in this type of system is relatively weak with the result that significant variation in the level of free copper ions can still occur. Where, on the other hand, a sequestrant of greater chelating power is used, such as EDTA, the level of free heavy metal ions in solution is reduced to such an extent that activation of the bleaching agent is minimal; in other words, the bleaching agent is "overstabilized".

A generally similar approach to the problem is described in DOS No. 2,657,043 in which a preformed iron(III)/chelate complex is added to the bleaching composition. This approach depends critically, however, on maintaining equivalence of chelate and heavy metal cations with the result that the system is unable to handle the significant variations of heavy metal content introduced via the wash load or wash solution.

A further disadvantage of the above techniques is that the sequestrant operates more-or-less exclusively as an auxiliary for the heavy metal cation and becomes unavailable for other detergency functions. This is particularly important for sequestrants such as ethylene diaminetetra(methylenephosphonic acid) and diethylenetriaminepenta(methylenephosphonic acid) which, in their uncomplexed forms, have significant bleachable-stain removal capabilities in their own right, especially at low wash temperatures.

The present invention therefore provides a catalyst composition for a peroxygen bleaching agent, the catalyst composition providing improved control of bleaching activity at both low and high wash temperatures. It also provides laundry bleaching and detergent compositions having more effective and efficient usage of peroxygen bleaching agent, thereby delivering an increased bleaching performance for any given level of peroxygen bleach, or minimizing the level of peroxygen bleach for any given level of bleaching end-result performance.

SUMMARY OF THE INVENTION

Accordingly, the present invention provides a catalyst composition for a peroxygen bleaching agent, the composition being soluble in water at pH 10 and being characterized by:

(a) a catalytic heavy metal cation having a catalytic activity for decomposition of the peroxygen bleaching agent of at least 10%, (b) an auxiliary metal cation having a catalytic activity for decomposition of the peroxygen bleaching agent of less than 10%, and (c) a sequestrant having logarithmic stability constants for the catalytic heavy metal cation ($pK_c$) and for the auxiliary metal cation ($pK_a$) satisfying the following conditions:

$$pK_c \geqq 15$$

$$pK_a \geqq 15, \text{ and}$$

$$0.1 \leqq (pK_c - pK_a) \leqq 10,$$

wherein the molar ratio of the sum total of (auxiliary metal cation+catalytic heavy metal cation) to sequestrant is in the range from 1:1 to 20:1 and the molar ratio of sequestrant to catalytic heavy metal cation is in the range from 1:1 to 40:1, preferably from 1:1 to 20:1.

The catalytic heavy metal cation is generally selected from Groups Va, VIa, VIIa, VIII and Ib elements of the Periodic Table, suitable metals including vanadium, chromium, manganese, iron, cobalt, copper, osmium, platinum, palladium and silver. Highly preferred are iron, manganese and copper. The auxiliary metal cation, in general terms, has a high oxidation potential (preferably of at least +1.5 eV), highly preferred being Group IIb and IIIb elements, especially zinc and aluminium. Nickel is also highly suitable, however.

When complexed, the catalytic heavy metal cation preferably possesses little or no bleach catalytic activity. Accordingly, in a preferred embodiment, the sequestrant forms at least a hexadentate complex with the catalytic heavy metal cation. In general terms, suitable sequestrants belong to the (poly)aminopolycarboxylate and (poly)aminopolyphosphonate classes. Preferred sequestrants of these general types are ethylenediaminetetraacetic acid, diethylenetriamine-pentaacetic acid, ethylenediaminetetra(methylenephosphonic acid), diethylenetriamine-penta(methylenephosphonic acid) and alkali-metal and alkaline-earth metal salts thereof.

In a highly preferred embodiment, the catalytic heavy metal cation is Cu(II), the auxiliary metal cation is Zn(II) or Al(III), the sequestrant is selected from ethylenediaminetetraacetic acid, ethylenediaminetetra(methylenephosphonic acid), alkali-metal or alkaline-earth metal salts thereof, and mixtures thereof, and the molar ratios both of total (auxiliary metal cation+catalytic heavy metal cation) to sequestrant and of sequestrant to catalytic heavy metal cation are in the range from about 1.1:1 to about 10:1, preferably from about 1.4:1 to about 6:1.

The present invention also provides laundry bleaching and detergent compositions comprising the catalyst composition described herein. The laundry bleaching compositions of the invention contain from about 5% to about 99.95%, preferably from about 20% to about 95% of peroxygen bleaching agent and from about 0.05% to about 5%, preferably from about 0.1% to about 2% of catalyst composition. The laundry detergent compositions, on the other hand, contain from 0% to about 40%, preferably from about 5% to about 25% of surfactant selected from anionic, nonionic, ampholytic and zwitterionic surfactants and mixtures thereof, from about 5% to about 90% preferably from about 15% to about 60% of inorganic or organic detergency builder (sequestering builders suitable in the present composition have $pK_{Ca}++$ of at least about 2 and $pK_c$ of less than 15, preferably less than about 14), from about 5% to about 35%, preferably from about 8% to about 25% of peroxygen bleaching agent, and from about 0.05% to about 2%, preferably from about 0.1% to about 1% of catalyst composition. In laundry bleaching and detergent compositions, the peroxygen bleaching agent and sequestrant composition are preferably in a weight ratio in the range from about 100:1 to about 10:1, more preferably from about 50:1 to about 15:1. The laundry bleaching and detergent compositions preferably contain from about 0.5 to about 3 mMoles % of auxiliary metal cation, from about 0.01 to about 2, more preferably from about 0.05 to about 1.5 mMoles % of catalytic metal cation and about 0.5 to about 3 mMoles % of sequestrant. For optimum performance, the laundry bleaching and detergent compositions are preferably buffered to a pH in 1% solution of at least about 9.5, preferably at least about 10. Suitable pH buffering materials are sodium carbonate and sodium metasilicate.

The laundry bleaching and detergent compositions of the invention are preferably prepared as a dry mixture of at least three particulate components, a first component comprising the auxiliary metal cation, a second component comprising the catalytic heavy metal cation, and a third component comprising particulate peroxygen bleaching agent. Desirably, the catalytic heavy metal cation is precomplexed with at least an equimolar amount of the sequestrant. This, in turn, is preferably a (poly)aminopolycarboxylate. Precomplexing the catalytic heavy metal cation and drymixing it in particulate form with the remainder of the composition have been found valuable for improving composition storage stability. Preferably, the complex of catalytic heavy metal cation and sequestrant is agglomerated in a matrix of water-soluble salt material, highly preferred being phosphate materials, especially the pyrophosphates, orthophosphates, acid orthophosphates and tripolyphosphates. Desirably, the agglomerate is substantially free of unbound water (ie, the agglomerate contains less than about 5%, especially less than about 1% thereof of moisture removeable by air-drying at 25° C.), although water in the form of water of hydration etc., can of course be present. Preferably, the agglomerates are prepared by agglomeration of a hydratable form of the water-soluble salt in, for example, a pan agglomerator, fluidized bed, Schugi mixer etc., followed by spray-on of an aqueous solution of the catalytic metal cation complex. If necessary, the agglomerates are finally dried. Alternatively, the catalytic heavy metal cation can be incorporated directly in the salt matrix by spray-drying or can be incorporated in a water-soluble or water-dispersible organic carrier having a melting point greater than about 30° C., preferably greater than about 40° C. Preferred carriers include $C_{16}$-$C_{24}$ fatty alcohols (eg hydrogenated tallow alcohol) having from about 10 to 100, preferably 14 to 40, ethylene oxide units, polyethyleneglycols having a molecular weight of from 400 to 40,000, preferably from 1500 to 10,000, and mixtures thereof in a weight ratio of from about 10:1 to about 1:2. Other suitable components of the agglomerates include polydimethylsiloxanes, paraffin oils, paraffin waxes, micro-crystalline waxes, hydrophobic silica etc. The catalytic heavy metal cation and carrier can then be agglomerated with water-soluble salt material.

In a preferred process embodiment, the laundry detergent compositions are prepared by spray drying an aqueous slurry comprising organic surfactant, detergency builder and auxiliary metal cation in the form of a water-soluble salt thereof, thereby forming a spray-dried base powder, precomplexing the catalytic heavy metal cation, admixed in the form of a water-soluble salt thereof, and at least an equimolar amount of the sequestrant, and dry-mixing the spray-dried base powder, the precomplexed catalytic heavy metal cation and the peroxygen bleaching agent. Alternatively the auxiliary metal cation can be added by dry mixing or by incorporating in a separate particulate agglomerate.

Drymixing precomplexed catalytic heavy metal cation is particularly valuable for storage stability reasons in the case of detergent compositions prepared by a spray-on of ethoxylated nonionic surfactant. Thus a preferred composition contains a dry mixture of:

(a) from about 40% to about 93.9% of spray dried base powder comprising from 0% to about 40% surfactant, from about 5% to about 90% inorganic or organic detergency builder, and from 0.5 to 3 mMoles% of auxiliary metal cation, (b) from about 0.1% to about 10% of an agglomerate comprising from about 0.01 to about 2, more preferably from about 0.05 to about 1.5 mMoles% of catalytic metal cation and from about 0.01 to about 3, preferably from about 0.05 to about 3 mMoles% of the sequestrant incorporated in a water-soluble or water-dispersible organic carrier having a melting point greater than about 30° C. and/or in a matrix of water-soluble salt, said agglomerate being substantially free of unbound water, and (c) from about 5% to about 35% of peroxygen bleaching agent; the composition additionally containing from about 1% to about 15% of ethoxylated nonionic surfactant sprayed onto the dry mixture of spray-dried base powder, agglomerate and peroxygen bleaching agent.

The present invention also provides a process for bleaching soiled fabrics comprising the step of contacting the fabrics with an aqueous wash liquor containing:

(a) from about $5.10^{-4}$ to about $3.10^{-1}$, preferably from about $8.10^{-3}$ to about $5.10^{-2}$ mMoles/liter of a catalytic heavy metal cation having a catalytic activity for decomposition of the peroxygen bleaching agent of at least 10%;

(b) from about $5.10^{-3}$ to about $6.10^{-1}$ preferably from about $2.10^{-2}$ to about $3.10^{-1}$ mMoles/liter of an auxiliary metal cation having a catalytic activity for decomposition of the peroxygen bleaching agent of less than about 10%, (c) a sequestrant having logarithmic stability constants for the catalytic heavy metal cation ($pK_c$) and for the auxiliary metal cation ($pK_a$) satisfying the following conditions:

$$pK_c \geqq 15$$

$$pK_a \geqq 15, \text{ and}$$

$$0.1 \leqq (pK_c - pK_a) \leqq 10,$$

wherein the molar ratio of the sum total of (auxiliary metal cation + catalytic heavy metal cation) to sequestrant is in the range from about 1:1 to about 20:1 and the molar ratio of sequestrant to catalytic heavy metal cation is in the range from about 1:1 to about 40:1, preferably from about 1:1 to about 20:1, and (d) from about 0.01 to about 10 g/liter of peroxygen bleaching agent.

The components of the compositions of the invention will now be discussed in more detail.

The catalytic heavy metal cation has a minimum level of catalytic activity for decomposition of the peroxygen bleaching agent of at least 10%, preferably at least 20%. In this context, the catalytic activity refers to the activity of a water-soluble, strong acid salt of the cation in enhancing the extent of decomposition of the peroxygen bleaching agent during a heat-up cycle representing typical laundry conditions. In detail, the catalytic activity is measured as follows:

In a Tergotometer is placed 1 liter of distilled water and 7.5 g of a standard detergent product containing 4.2% sodium $C_{11.8}$ linear alkyl benzene sulphonate, 8.75% Dobanol 45E7 (a condensation product of an average of 7 moles of ethylene oxide with a $C_{14}$–$C_{15}$ primary alcohol, Dobanol being a registered Trade Mark), 32.2% anhydrous pentasodium tripolyphosphate, 5% sodium silicate ($SiO_2$:$Na_2O$=1.6:1), 21.6% sodium perborate tetrahydrate, the remainder being sodium sulfate.

The solution is agitated at 60 rpm and then subjected to the following controlled heat-up cycle: 36° C. after 10 minutes, 52° C. after 20 minutes, 66° C. after 30 minutes, 75° C. after 40 minutes, 81° C. after 50 minutes and 85° C. after 60 minutes. 10 ml aliquots of the solution extracted at intervals of 10 minutes throughout the heat-up cycle are then pipetted into 10 ml portions of 20% sulfuric acid solution and then diluted with 100 mls of 55° C. water. A sample thereof is then immediately titrated with 0.1 N potassium permanganate solution.

The percentage of perborate decomposition (D°) is then $$D^\circ = 100 - \left( \frac{\text{Titre at 60 mins}}{\text{Titre at 10 mins}} \times 100 \right)$$

The above procedure is repeated adding $2.93 \times 10^{-5}$ moles of the test metal cation in the form of its chloride salt.

The percentage of perborate decomposition (D) thus obtained is then used to determine the catalytic activity of the cation as follows:

$$\text{Catalytic activity} = D - D^\circ$$

Highly preferred catalytic heavy metal cations are cations of copper (especially Cu(II)), iron (especially Fe(III)) and manganese (especially Mn(III)). The compositions of the invention are prepared by admixing the catalytic heavy metal cation in the form of a water-soluble salt thereof, especially the chloride or sulfate salts, with the sequestrant and auxiliary metal cation.

The auxiliary metal cation can also be defined by reference to its catalytic activity according to the test described above. Thus, the auxiliary metal cation has a catalytic activity for decomposition of the peroxygen bleaching agent of less than 10%, preferably less than 5%. Highly preferred auxiliary metal cations are zinc (as Zn(II)), aluminium (as Al(III)) and nickel (as Ni(II)). These again are used to make the compositions of the invention in the form of water-soluble, strong acid (e.g., chloride or sulfate) salts.

The sequestrant component of the present compositions is a multidentate ligand forming a complex with both the catalytic heavy metal cation and the auxiliary metal cation. Both complexes are soluble in water at pH 10, preferably to an extent of at least 1% (W/W). The logarithmic stability constants for the catalytic heavy metal cation ($pK_c$) and auxiliary metal cation ($pK_a$) are defined by reference to the equations:

$$C + X \rightleftharpoons CX$$

$$A + X \rightleftharpoons AX$$

where C and A are the catalytic and auxiliary metal ions respectively and X is the sequestrant in fully deprotonated form.

The equilibrium constants are therefore $$K_c = \frac{(CX)}{(C)(X)} \text{ and } K_a \frac{(AX)}{(A)(X)}$$

$$pK_c = \log_{10} K_c \text{ and } pK_a = \log_{10} K_a$$

The logarithmic stability constants pKHD c and $pK_a$ should both be at least 15, with $pK_c$ preferably being at least about 18 and $pK_a$ preferably being at least about 16. The difference in logarithmic stability constants ($pK_c$-$pK_a$) should be in the range from 0.1 to 10, preferably from about 0.5 to about 5, especially from about 1 to about 3.

Literature values of stability constants are taken where possible (see Stability Constants of Metal-Ion Complexes, Special Publication No. 25, the Chemical Society, London).

Otherwise, the stability constant is defined at 25° C. and 0.1 molar KCl, using a glass electrode method of measurement as described in Complexation in Analytical Chemistry by Anders Ringbom (1963). The stability constants for C and A should, of course, be measured under identical conditions.

Suitable sequestrants herein are selected from (poly)aminopolycarboxylic acids, polyphosphonic acids, (poly)aminopolyphosphonic acids and alkali-metal and alkaline-earth metal salts thereof, especially those sequestrants forming at least hexadentate ligands. Preferred species of sequestrants have the general formula

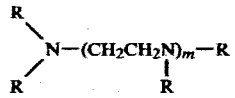

wherein each R is H, $CO_2H$, $CH_2CO_2H$ or $CH_2PO_3H_2$ or an alkali metal or alkaline earth metal salt thereof and m is from 1 to 10, providing that at least four R groups have the formula $CO_2H$, $CH_2CO_2H$ or $CH_2PO_3H_2$. In highly preferred sequestrants, R is $CO_2H$ or $CH_2PO_3H_2$ and m is from 1 to 3. Especially preferred are ethylenediaminetetraacetic acid (EDTA), diethylenetriaminepentaacetic acid (DETPA), ethylenediaminetetra(methylenephosphonic acid) (EDTMP), diethylenetriaminepenta(methylenephosphonic acid) (DETPMP) and alkali metal and alkaline earth metal salts thereof. Other suitable phosphonate sequestrants include aminotrimethylene phosphonic acid (NTMP) and ethane-1-hydroxy-1,1-diphosphonic acid (EHDP) and their salts. A mixture of EDTA and/or DETPA with EDTMP and/or DETPMP in a molar ratio of from about 1:10 to about 10:1, preferably from about 1:1 to about 5:1 is especially suitable.

Representative stability data for the above sequestrants are given below

| | Cu (II) | Mn (III) | Fe (III) | Zn (II) | Al (III) | Ni (II) |
|---|---|---|---|---|---|---|
| EDTA | 18.8 | 24.9 | 25.0 | 16.2 | 16.8 | 18.6 |
| DETPA | — | — | 27.3 | 18.7 | 18.5 | — |
| EDTMP | 19.0 | — | 19.6 | 17.0 | — | 15.3 |
| DETPMP | 19.5 | — | — | 16.5 | — | — |

It is an important feature of the present compositions that the sequestrant is used in at least a 1:1 molar ratio with regard to the catalytic heavy metal cation and that the catalytic heavy metal cation and auxiliary metal cation, in total, are used in at least a 1:1 molar ratio with regard to the sequestrant. This is necessary to provide the correct buffering capacity for controlling excess heavy metal cations introduced during the wash process from the wash solution or wash load. Preferably, the auxiliary metal cation itself is also present in at least a 1:1 molar ratio with regard to the sequestrant. Thus in preferred compositions, the molar ratio of auxiliary metal cation to sequestrant is in the range from about 1:1 to about 10:1, more preferably from about 1.1:1 to about 4:1.

Peroxygen bleaching agents suitable for use in the present compositions include hydrogen peroxide, inorganic peroxides and peroxy salts, hydrogen peroxide addition compounds, and organic peroxides and peroxy acids. Organic peroxyacid bleach precursors (bleach activators) can additionally be present. Preferred bleaching agents include alkali metal perborates, percarbonates, persulfates and perphosphates, peroxylauric acid, diperoxydodecanedioic acid, diperoxyazelaic acid, mono- and diperoxyphthalic acid and mono- and diperoxyisophthalic acid. Highly preferred are sodium perborate mono- and tetrahydrates. Suitable bleach activators include methyl o-acetoxy benzoate, sodium-p-acetoxy benzene sulphonate, Bisphenol A diacetate, tetraacetyl ethylenediamine, tetraacetyl hexamethylenediamine, tetraacetyl methylenediamine, and tetraacetylglycouril and pentaacetylglucose. These can be added at a weight ratio of bleaching agent to bleach activator in the range from about 40:1 to about 4:1. Surprisingly, it is found that the bleach catalyst system of the invention is effective in combination with a conventional bleach activator to provide improved bleaching across the whole range of wash temperatures.

A wide range of surfactants can be used in the present laundry compositions. A typical listing of the classes and species of these surfactnts is given in U.S. Pat. No. 3,663,961 issued to Norris on May 23, 1972 and incorporated herein by reference.

Water-soluble salts of the higher fatty acids, i.e. "soaps", can be included in the compositions of the invention. This class of detergents includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralisation of free fatty acids. Particularly useful are the sodium and potassium salts of the mixture of fatty acids derived from coconut oil and tallow i.e. sodium or potassium tallow and coconut soap.

Suitable synthetic anionic surfactants are water-soluble salts of alkyl benzene sulfonates, alkyl sulfates, alkyl polyethoxy ether sulfates, paraffin sulfonates, alpha-olefin sulfonates, alpha-sulfocarboxylates and their esters, alkyl glyceryl ether sulfonates, fatty acid monoglyceride sulfates and sulfonates, alkyl phenol polyethoxy ether sulfates, 2-acyloxy-alkane-1-sulfonate, and beta-alkyloxy alkane sulfonate.

A particularly suitable class of anionic detergents includes water-soluble salts, particularly the alkali metal, ammonium and alkanolammonium salts or organic sulfuric reaction products having in their molecular structure an alkyl or alkaryl group containing from about 8 to about 22, especially from about 10 to about 20 carbon atoms and a sulfonic acid or sulfuric acid ester group. (Included in the term "alkyl" is the alkyl portion of acyl groups). Examples of this group of synthetic detergents which form part of the detergent compositions of the present invention are the sodium and potassium alkyl sulfates, especially those obtained by sulfating the higher alochols ($C_8$–$C_{18}$) carbon atoms produced by reducing the glycerides of tallow or coconut oil and sodium and potassium alkyl benzene sulfonates, in which the alkyl group contains from about 9 to about 15, especially about 11 to about 13, carbon atoms, in straight chain or branched chain configuration, e.g. those of the type described in U.S. Pat. Nos. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulfonates in which the average of the alkyl group is about 11.8 carbon atoms, abbreviated as $C_{11.8}$ LAS.

Other anionic detergent compounds herein include the sodium $C_{10}$–$C_{18}$ alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts or esters of α-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; alkyl ether sulfates containing from about 10 to 18, especially about 12 to 16, carbon atoms in the alkyl group and from about 1 to 12, especially 1 to 6, more especially 1 to 4 moles of ethylene oxide; water-soluble salts of olefin sulfonates containing from about 12 to 24, preferably about 14 to 16, carbon atoms, especially those made by reaction with sulfur trioxide followed by neutralization under conditions such that any sultones present are hydrolysed to the corresponding hydroxy alkane sulfonates; water-soluble salts of paraffin sulfonates containing from about 8 to 24, especially 14 to 18 carbon atoms, and β-alkyloxy alkane sulfonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred. Magnesium and calcium are preferred cations under circumstances described by Belgian Pat. No. 843,636 invented by Jones et al, issued Dec. 30, 1976. Mixtures of anionic surfactants are contemplated by this invention; a preferred mixture contains alkyl benzene sulfonate having 11 to 13 carbon atoms in the alkyl group or paraffin sulfonate having 14 to 18 carbon atoms and either an alkyl sulfate having 8 to 18, preferably 12 to 18, carbon atoms in the alkyl group, or an alkyl polyethoxy alcohol sulfate having 10 to 16 carbon atoms in the alkyl group and an average degree of ethoxylation of 1 to 6.

Ethoxylated nonionic surfactants materials can be broadly defined as compounds produced by the condensation of ethylene oxide groups (hydrophilic in nature) with an organic hydrophobic compound, which may be aliphatic or alkyl aromatic in nature. The length of the polyoxyethylene group which is condensed with any particular hydrophobic group can be readily adjusted to yield a water-soluble compound having the desired degree of balance between hydrophilic and hydrophobic elements. In general, ethoxylated nonionic surfactants suitable herein have an average ethyleneoxy content in the range from about 35% to about 70% and especially from about 50% to about 62.5% by weight of the surfactant.

Examples of suitable nonionic surfactants include the condensation products of primary or secondary aliphatic alcohols having from 8 to 24 carbon atoms, in either straight chain or branched chain configuration, with from 2 to about 18 moles of alkylene oxide per mole of alcohol. Preferably, the aliphatic alcohol comprises between 9 and 15 carbon atoms and is ethoxylated with between 2 and 9, desirably between 3 and 8 moles of ethylene oxide per mole of aliphatic alcohol. Such nonionic surfactants are preferred from the point of view of providing good to excellent detergency performance on fatty and greasy soils, and in the presence of hardness sensitive anionic surfactants such as alkyl benzene sulfonates. The preferred surfactants are prepared from primary alcohols having no more than about 50% chain branching, ie. which are either linear (such as those derived from natural fats or, prepared by the Ziegler process from ethylene, e.g. myristyl, cetyl, stearyl alcohols), or partly branched such as the Dobanols and Neodols which have about 25% 2-methyl branching (Dobanol and Neodol being Trade Names of Shell) or Synperonics, which are understood to have about 40% to 50% 2-methyl branching (Synperonic is a Trade Name of I.C.I.) Specific examples of nonionic surfactants falling within the scope of the invention include Dobanol 45-4, Dobanol 45-7, Dobanol 45-9, Dobanol 91-3, Dobanol 91-6, Dobanol 91-8, Synperonic 6, Synperonic 9, the condensation products of coconut alcohol with an average of between 5 and 9 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, for example, those ethoxylates of the Tergitol series having from about 9 to 15 carbon atoms in the alkyl group and up to about 11, especially from about 3 to 9, ethoxy residues per molecule.

Of the above, highly preferred are alkoxylated nonionic surfactants having an average HLB in the range from about 9.5 to 13.5, especially 10 to 12.5. Highly suitable nonionic surfactants of this type are ethoxylated primary $C_{9-15}$ alcohols having an average degree of ethoxylation from about 2 to 9, more preferably from about 2 to 8.

Suitable ampholytic surfactants are water-soluble derivatives of aliphatic secondary and tertiary amines in which the aliphatic moiety can be straight chain or branched and wherein one of the aliphatic substituents contains from about 8 to 18 carbon atoms and one contains an anionic water-solubilizing group, e.g. carboxy, sulfonate, sulfate, phosphate, or phosphonate.

Suitable zwitterionic surfactans are water soluble derivatives of aliphatic quaternary ammonium phosphonium and sulfonium cationic compounds in which the aliphatic moieties can be straight chain or branched, and wherein one of the aliphatic substituents contains from about 8 to 18 carbon atoms and one contains an anionic water-solubilizing groups.

In addition to the above surfactants, the compositions of the invention can also be supplemented by low levels, preferably up to about 6%, of cosurfactans, especially amine oxides, quaternary ammonium surfactants and mixtures thereof. Suitable amine oxides are selected from mono $C_8$–$C_{20}$, preferably $C_{10}$–$C_{14}$ N-alkyl or alkenyl amine oxides and propylene-1,3-diamine dioxides wherein the remaining N positions are substituted by methyl, hydroxyethyl or hydroxypropyl. Suitable quaternary ammonium surfactants are selected from mono $C_8$–$C_{16}$, preferably $C_{10}$–$C_{14}$ N-alkyl or alkenyl ammonium surfactants wherein remaining N positions are again substituted by methyl, hydroxethyl or hydroxypropyl.

The laundry compositions of the invention can also contain from about 5% to about 90% of detergency builder, preferably from about 15% to about 60% thereof.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, polyphosphates, tripolyphosphates and bicarbonate.

Examples of suitable organic alkaline detergency builder salts are water-soluble polycarboxylates such as the salts of nitrilotriacetic acid, lactic acid, glycollic acid and ether derivatives thereof as disclosed in Belgian Patent Nos. 821,368, 821,369 and 821,370; succinic acid, malonic acid, (ethylenedioxy)diacetic acid, maleic acid, diglycollic acid, tartaric acid, tartronic acid and fumaric acid; citric acid, aconitic acid, citraconic acid, carboxymethyloxysuccinic acid, lactoxysuccinic acid, and 2-oxy-1,1,3-propane tricarboxylic acid; oxydisuccinic acid, 1,1,2,2-ethane tetracarboxylic acid, 1,1,3,3-propane tetracarboxylic acid and 1,1,2,3-propane tetracarboxylic acid; cyclopentane cis, cis,cis-tetracarboxylic acid, cyclopentadienide pentacarboxylic acid, 2,3,4,5-tetra hydrofuran-cis, cis, cis-tetracarboxylic acid, 2,5-tetra-hydrofuran-cis-di-carboxylic acid, 1,2,3,4,5,6-hexane-hexacarboxylic acid, mellitic acid, pyromellitic acid and the phthalic acid derivatives disclosed in British Pat. No. 1,425,343.

Mixtures of organic and/or inorganic builders can be used herein. One such mixture of builders is disclosed in Canadian Patent No. 755,038, e.g. a ternary mixture of sodium tripolyphosphate, trisodum nitrilotriacetate, and trisodium ethane-1-hydroxy-1,1-diphosphonate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of British Patent Specification No. 1,429,143 published Mar. 24, 1976, German Patent Application No. OLS 2,433,485 published Feb. 6, 1975, and OLS No. 2,525,778 published Jan. 2, 1976, the disclosures of which are incorporated herein by reference.

Another suitable component of the present compositions is a water-soluble magnesium salt which is added at levels in the range from about 0.015% to about 0.2%, preferably from about 0.03% to about 0.15% and more preferably from about 0.05% to about 0.12% by weight of the compositions (based on weight of magnesium). Suitable magnesium salts include magnesium sulfate, magnesium sulfate heptahydrate, magnesium chloride, magnesium chloride hexahydrate, magnesium fluoride and magnesium acetate. Desirably, the magnesium salt is added to the compositions as part of the aqueous slurry crutcher mix and is then converted to dry granular form, for instance by spray drying. The magnesium salt can provide additional low temperature stain removal benefits as described in copending British Patent Application No. 80/15542.

The compositions of the present invention can be supplemented by all manner of detergent components, either by including such components in the aqueous slurry to be dried or by admixing such components with the compositions of the invention following the dry step. Soil-suspending agents at about 0.1% to 10% by weight such as water-soluble salts of carboxymethylcellulose, carboxyhydroxymethyl cellulose, and polyethylene glycols having a molecular weight of about 400 to 10,000 are common components of the present invention. Dyes, pigment optical brighteners, and perfumes can be added in varying amounts as desired.

Other materials such as fluorescers, enzymes in minor amounts, anti-caking agents such as sodium sulfosuccinate, and sodium benzoate can also be added. Enzymes suitable for use herein include those discussed in U.S. Pat. Nos. 3,519,570 and 3,533,139 to McCarty and McCarty et al issued July 7, 1970 and Jan. 5, 1971, respectively.

Anionic fluorescent brightening agents are well-known materials, examples of which are disodium 4,4'-bis-(2-diethanolamino-4-anilino-s-triazin-6-ylamino) stilbene-2:2' disulphonate, disodium 4,4'-bis-(2-morpholino-4-anilino-s-triazin-6-ylaminostilbene-2:2'-disulphonate, disodium 4,4'-bis-(2,4-dianilino-s-triazin-6-ylamino)stilbene-2:2'-di-sulphonate, disodium 4,4'-bis(2-anilino-4-(N-methyl-N-2-hydroxyethylamino)-s-triazin-6-ylamino)stilbene-2,2'-desulphonate, disodium 4,4'-bis(4-phenyl-2,1,3-triazol-2-yl)-stilbene-2,2'-disulphonate, disodium 4,4'-bis(2-anilino-4-(1-methyl-2-hydroxyethylamino)-s-triazin-6-ylamino)stilbene-2,2'disulphonate and sodium 2(stilbyl-4''-(npatho-1',2':4,5)-1,2,3-triazole-2''-sulphonate.

An alkali metal, or alkaline earth metal, silicate can also be present. The alkali metal silicate is preferably from about 3% to about 15%. Suitable silicate solids have a molar ratio of $SiO_2$/alkali metal$_2$O in the range from about 1.0 to about 3.3, more preferably from 1.5 to 2.0.

Other optional ingredients include suds modifiers particularly those of suds suppressing type, exemplified by silicones, and silica-silicone mixtures.

U.S. Pat. No. 3,933,672 issued Jan. 20, 1976, to Bartollota et al., incorporated herein by reference, discloses a silicone suds controlling agent. The silicone material can be represented by alkylated polysiloxane materials such as silica aerogels and xerogels and hydrophobic silicas of various types. The silicone material can be described as siloxane having the formula:

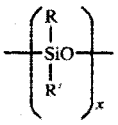

wherein x is from about 20 to about 2,000 and R and R' are each alkyl or aryl groups, especially methyl, ethyl, propyl, butyl and phenyl. The polydimethylsiloxanes (R and R' are methyl) having a molecular weight within the range of from about 200 to about 2,000,000, and higher, are all useful as suds controlling agents. Additional suitable silicone materials wherein the side chain groups R and R' are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpolysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling atent is represented by a hydrophobic silanated (most preferably trimethylsilanated) silica having a particle size in the range from about 10 millimicrons to 20 millimicrons and a specific surface area above about 50 $m^2/g$. intimately admixed with dimethyl silicone fluid having a molecular weight in the range from about 500 to about 200,000 at a weight ratio of silicone to silanated silica of from about 1:1 to about 1:10. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in German Patent Application DTOS No. 2,646,126 published Apr. 28, 1977 and incorporated herein by reference. An example of such a compound is DB-544, commercially available from Dow Corning, which is a siloxane/-glycol copolymer.

Suds modifiers as described above are used at levels of up to approximately 5%, preferably from 0.1 to 2% by weight of the nonionic surfactant. They can be incorporated into the particulates of the present invention or can be formed into separate particulates that can then be mixed with the particulates of the invention. The incorporation of the suds modifiers as separate particulates also permits the inclusion therein of other suds controlling material such as microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

A preferred additional ingredient is a homo- or copolymeric polycarboxylic acid or salt thereof wherein the polycarboxylic acid comprises at least two carboxyl radicals separated from each other by not more than two carbon atoms. Polymers of this type are disclosed in British Pat. No. 1,596,756 incorporated herein by reference. Preferred polymers include copolymers or salts thereof of maleic anhydride with ethylene, methylvinyl ether, acrylic acid, or methacrylic acid, the maleic anhydride constituting at least about 20, preferably at least 33 Mole percent of the copolymer. These polymers are valuable for improving whiteness maintenance, fabric ash deposition, and cleaning performance on clay, proteinaceous and oxidizable soils in the presence of transition metal impurities.

Another suitable ingredient is a photoactivator as disclosed in European Application No. 82300309, highly preferred materials being zinc phthalocyanine tri- and tetrasulphonates.

In the Examples which follow, the abbreviations used having the following designation:

LAS: Linear $C_{11.8}$ alkyl benzene sulphonate.

$AE_3S$: Sodium linear $C_{12-14}$ alcohol sulfate including 3 ethylene oxide moieties.

TAS: Tallow alcohol sulfate.

MAO: $C_{12}$–$C_{14}$ alkyl dimethylamine oxide.

Dobanol 45-E-7: A $C_{14-15}$ oxo-alcohol with 7 moles of ethylene oxide, marketed by Shell.

TAED: Tetraacetyl ethylene diamine.

Silicate: Sodium silicate having an $SiO_2$:$Na_2O$ ratio of 1.6:1.

Wax: Microcrystalline wax-Witcodur 272 M.pt 87° C.

Silicone Prill: Comprising 0.14 parts by weight of an 85.15 by weight mixture of silinated silica and silicone granulated with 1.3 parts of sodium tripolyphosphate, and 0.56 parts of tallow alcohol condensed with 25 molar proportions of ethylene oxide.

Porphine: Tri/tetra sulphonated zinc phthalocyanine.

Gantrez AN119: Trade Name for maleic anhydride/-vinyl methyl ether co-polymer, believed to have an average molecular weight of about 240,000, marketed by GAF. This was prehydrolysed with NaOH before addition.

MA/AA: Copolymer of 1:4 maleic/acrylic acid, average molecular weight about 80,000.

Brightener: Disodium 4,4'-bis(2-morpholino-4-anilino-s-triazino-6-ylamino)stilbene-2:2'-disulphonate.

Dequest 2060: Trade Name for diethylenetriaminepenta(methylenephosphonic acid), marketed by Monsanto.

Dequest 2041: Trade Name for ethylenediamine tetra(methylene phosphonic acid) monohydrate, marketed by Monsanto.

The present invention is illustrated by the following non-limiting examples:

EXAMPLES I–IX

The following granular laundry detergent compositions are prepared by precomplexing the catalytic heavy metal (chloride salt) with at least a molar excess of the amino-polycarboxylate or aminopolyphosphonate sequestrant, admixing the auxiliary metal (chloride salt) and the remaining sequestrant together with all other ingredients, apart from the complex, nonionic surfactant, bleach, silicone prill, sodium carbonate and enzyme, in a crutcher as an aqueous slurry, spray-drying the slurry at high temperature in a spray-drying tower, admixing the complex, bleach, silicone prill, sodium carbonate and enzyme with the spray-dried detergent base powder, and spraying the nonionic surfactant onto the resulting granular mixture.

| | EXAMPLES | | | | | | | | |
|---|---|---|---|---|---|---|---|---|---|
| | I | II | III | IV | V | VI | VII | VIII | XI |
| LAS | 4 | 4 | — | 2 | — | 4 | 7 | 7 | 8 |
| $AE_3S$ | — | — | 3 | — | — | — | — | — | — |
| TAS | — | 3 | 3 | — | 4 | 4 | 3 | 2 | 2 |
| MAO | — | — | — | — | — | — | — | — | 1 |
| Dobanol 45-E-7 | 8 | 9 | 12 | 12 | 8 | 8 | 6 | 7 | — |
| Dobanol 45-E-4 | — | — | — | 3 | 4 | — | — | — | — |
| TAED | — | — | — | — | — | 2 | — | 1 | 1 |
| Silicate | 5 | 7 | 4 | 10 | 8 | 5 | 5 | 6 | 8 |
| Wax | 0.6 | — | 0.5 | 1.5 | 1.0 | 0.5 | — | — | — |
| Silicone Prill | 1 | 1.5 | 0.5 | 0.2 | 0.5 | 0.5 | 2 | 1 | 0.5 |

-continued

| | EXAMPLES | | | | | | | | |
|---|---|---|---|---|---|---|---|---|---|
| | I | II | III | IV | V | VI | VII | VIII | XI |
| Gantrez AN119 | 0.4 | — | 0.4 | 1.0 | — | 1.0 | — | — | — |
| MA/AA | — | — | — | — | — | — | 0.6 | 1.2 | 1.0 |
| Brightener | 0.2 | 0.3 | 0.25 | 0.1 | 0.4 | 0.2 | 0.2 | 0.2 | 0.01 |
| Porphine | — | — | — | — | — | — | — | — | 0.1 |
| Cu (II) (mMoles) | 0.4 | 0.16 | — | 0.5 | — | 0.3 | 0.3 | 0.1 | 0.05 |
| Fe (III) (mMoles) | — | — | 0.64 | — | 0.4 | — | — | — | — |
| Zn (II) (mMoles) | 1.6 | 1.6 | 2.4 | — | — | 0.8 | — | — | — |
| Al (III) (mMoles) | — | — | — | 1.0 | 1.6 | 0.8 | 1.8 | 1.5 | 2.0 |
| EDTA (mMoles) | 1.0 | 0.5 | 0.5 | 0.6 | — | 0.5 | 0.8 | 0.4 | 0.9 |
| DETPA (mMoles) | — | 0.5 | — | — | 1.0 | — | — | — | — |
| EDTMP (mMoles) | 0.36 | 0.36 | 0.6 | — | — | 0.5 | 0.4 | — | 0.2 |
| DETPMP (mMoles) | — | — | — | 0.4 | 0.3 | 0.5 | — | 0.3 | |
| Sodium Perborate | 15 | 10 | 20 | 25 | 20 | 12 | 18 | 15 | 30 |
| Alcalase Enzyme | 0.6 | — | — | 1.0 | — | 0.8 | 0.6 | 1 | 1 |
| Sodium Tri-Polyphosphate | 33 | 30 | 28 | 24 | 35 | 24 | 30 | 24 | 26 |
| Sodium Carbonate | — | — | — | — | — | — | 5 | 12 | — |
| Magnesium sulfate | 0.5 | — | — | — | — | — | — | — | 0.5 |
| Sodium sulfate, moisture & miscellaneous | | | | | To 100 | | | | |

Compared with compositions containing no auxiliary metal cation, the above compositions deliver improved detergency performance on bleachable-type stains such as tea, coffee, wine and fruit juice, particularly at medium to high wash temperatures.

The above examples are repeated, with the catalytic heavy metal salt and EDTA or DETPA as appropriate sprayed onto an agglomerate containing 62 parts sodium tripolyphosphate (anhydrous), 18.3 parts water and 2 parts tallowalcohol $EO_{25}$. The agglomerate is added at 3% in final product. These compositions again deliver excellent detergency performance on bleachable type stains.

EXAMPLES X TO XVIII

The above examples are repeated, but the silicone prill is removed and the catalytic heavy metal salt precomplexed with either the EDTA and/or DETPA as appropriate is added as an agglomerate additionally containing 47% sodium tripolyphosphate (anhydrous basis), 13% water, 10% silicone/silica mixture (20:1 ratio), and the remainder consisting of a 50:50 mixture of tallowalcohol $EO_{25}$ and polyethyleneglycol 4000. The agglomerate is added at 2.2% in final product. These compositions combine excellent storage stability and detergent performance on bleachable type stains.

What is claimed is:

1. A laundry detergent composition comprising from about 0% to about 40% of surfactant selected from anionic, nonionic, ampholytic and zwitterionic surfactants and mixtures thereof, from about 5% to about 90% of inorganic or organic detergency builder, from about 5% to about 35% of particulate peroxygen bleaching agent, and from about 0.05% to about 2% of a catalyst system soluble in water at pH 10 and comprising a dry mixture of:

(a) a first particulate component comprising a catalytic heavy metal cation having a catalytic activity for decomposition of the peroxygen bleaching agent of at least 10%, selected from the group consisting of cations of vanadium, chromium, manganese, iron, cobalt, copper, osmium, platinum, palladium, silver, mercury, and lead, (b) a second particulate component comprising an auxiliary metal cation having a catalytic activity for decomposition of the peroxygen bleaching agent of less than 10%, selected from the group consisting of cations of zinc, aluminum and nickel, and (c) a water soluble sequestrant selected from the group consisting of ethylenediaminetetraacetic acid, diethylenetriaminepentaacetic acid, ethylenediaminetetra-(methylenephosphinic acid), diethylenetriaminepenta-(methylene phosphonic acid), and alkali-metal and alkaline-earth metal salts thereof, wherein the molar ratio of the sum total of (auxiliary metal cation+catalytic heavy metal cation) to sequestrant is in the range from 1:1 to 20:1 and the molar ratio of sequestrant to catalytic heavy metal cation is in the range from 1:1 to 40:1.

2. A composition according to claim 1 wherein the catalytic heavy metal cation is Cu(II), the auxiliary metal cation is selected from Zn(II) and Al(III), the sequestrant is selected from ethylenediamine-tetraacetic acid, ethylenediaminetetra(methylene-phosphonic acid), mixtures thereof and alkali-metal or alkaline earth metal salts thereof, and wherein the molar ratio of the sum total of (auxiliary metal cation+catalytic heavy metal cation) to sequestrant is in the range from 1.1:1 to 10:1 and the molar ratio of sequestrant to catalytic heavy metal cation is in the range from 1.1:1 to 10:1.

3. A composition according to claim 1 wherein the second particulate component is an agglomerate comprising from about 0.01 to about 2, preferably from about 0.05 to about 1.5 mMoles% of catalytic metal cation and from about 0.01 to about 3, preferably from about 0.05 to about 3 mMoles% of sequestrant incorporated in a water-soluble or water-dispersible organic carrier having a melting point greater than about 30° C., preferably greater than about 40° C.

4. A composition according to claim 3 wherein the organic carrier is selected from $C_{16}$–$C_{24}$ fatty alcohols ethoxylated with from 10 to 100 ethylene oxide units, polyethyleneglycols having a molecular weight of from about 400 to about 40,000 and mixtures thereof.

5. A composition according to claim 1 comprising a dry mixture of:

(a) from about 40% to about 93.9% of spray dried base powder comprising from 0% to about 40% surfactant, from about 5% to about 90% inorganic or organic detergency builder, and from about 0.5 to about 3 mMoles% of auxiliary metal cation, (b) from about 0.1% to about 10% of an agglomerate comprising from about 0.01 to about 2, preferably about 0.05 to about 1.5 mMoles% of catalytic metal cation and from about 0.01 to about 3, preferably from about 0.05 to about 3 mMoles% of the sequestrant incorporated in a water-soluble or water-dispersible organic carrier having a melting point of at least about 30° C. and/or in a matrix of water-soluble salt, said agglomerate being substantially free of unbound water, and (c) from about 5% to about 35% of peroxygen bleaching agent;

the composition additionally containing from 1% to 15% of ethoxylated nonionic surfactant sprayed onto the dry mixture of spray-dried base powder, agglomerate and peroxygen bleaching agent.

6. A process for making the composition of claim 1 comprising the step of precomplexing the catalytic heavy metal cation and sequestrant prior to admixture with the peroxygen bleaching agent.

7. A process according to claim 6 comprising the steps of agglomerating the complex of catalytic heavy metal cation and sequestrant with a water-soluble or water-dispersible organic carrier having a melting point of at least about 30° C. and/or with a water-soluble salt whereby the agglomerate so formed is substantially free of unbound water, and dry-mixing the agglomerate with a separate particulate component comprising the auxiliary metal cation and with particulate peroxygen bleaching agent.

* * * * *